United States Patent [19]

Yoshida

[11] Patent Number: 4,646,397

[45] Date of Patent: Mar. 3, 1987

[54] SURFACE-TYPE FASTENER

[75] Inventor: Hiroshi Yoshida, Kurobe, Japan

[73] Assignee: Yoshida Kogyo K. K., Tokyo, Japan

[21] Appl. No.: 744,255

[22] Filed: Jun. 13, 1985

[30] Foreign Application Priority Data

Jun. 18, 1984 [JP] Japan ..... 59-90592[U]

[51] Int. Cl.[4] ..... A44B 13/00

[52] U.S. Cl. ..... 24/442; 24/443; 24/448; 2/DIG. 6

[58] Field of Search ..... 24/442, 443, 444, 445, 24/446, 447, 448, 451, 452, 426; 2/DIG. 6; 112/265.1, 406

[56] References Cited

U.S. PATENT DOCUMENTS

| | | | |
|---|---|---|---|
| 3,009,235 | 11/1961 | de Mestral | 24/445 |
| 3,136,026 | 6/1964 | de Mestral | 24/445 |
| 3,383,738 | 5/1968 | Fox et al. | 2/DIG. 6 |
| 3,464,094 | 9/1969 | Mates | 24/443 |
| 3,525,376 | 8/1970 | Muhlhauser | 24/442 |
| 3,537,108 | 11/1970 | Daniels | 2/DIG. 6 |
| 3,849,840 | 11/1974 | Yamada et al. | 24/448 |
| 4,089,068 | 5/1978 | Swallow | 2/DIG. 6 |
| 4,139,133 | 2/1979 | Repka | 2/DIG. 6 |
| 4,165,555 | 8/1979 | Boxer et al. | 24/444 |
| 4,212,052 | 7/1980 | Chambard | 2/DIG. 6 |

FOREIGN PATENT DOCUMENTS

| | | | |
|---|---|---|---|
| 2153599 | 8/1973 | Fed. Rep. of Germany | 24/442 |
| 57-15684 | 4/1982 | Japan . | |
| 57-27289 | 6/1982 | Japan . | |
| 1080653 | 8/1967 | United Kingdom | 24/442 |

*Primary Examiner*—Victor N. Sakran

*Attorney, Agent, or Firm*—Hill, Van Santen, Steadman & Simpson

[57] ABSTRACT

A surface-type fastener comprising a pair of fabric fastener strips, one fastener strip having on its one surface a number of hook-shaped engaging elements engageable with a number of loop-shaped engaging elements on one surface of the other fastener strip. One surface of each fastener strip has a first region in which the engaging elements are disposed, and a second region devoid of engaging elements. The other surface of the individual fastener strip has, in registry with the first region, an area covered with synthetic resin.

6 Claims, 4 Drawing Figures

SURFACE-TYPE FASTENER

BACKGROUND OF THE INVENTION

1. Field of the Invention

The present invention relates to a surface-type fastener such as a hook-and-loop fastener including a pair of interengaging fabric fastener strips, one fastener strip having on its one surface a number of hook-shaped or mushroom-shaped engaging elements engageable with a number of loop-shaped engaging elements projecting from one surface of the other fastener strip.

2. Prior Art

A common problem with known surface-type fasteners was that engaging elements in the form of hook or loops would tend to come off the individual fabric fastener strip or to become objectionably loose as the two fabric fastener strips were interengaged and disengaged repeatedly.

To this end, it is known to apply synthetic resin over the element-free rear surface of the individual fastener strip in order to fix or stablize the engaging elements so that they retain their shape and position, thus preventing the engaging elements from being removed or otherwise impaired. However, this backing with synthetic resin would make the fastener strips less flexible so that a sewing needle is not allowed to smoothly pierce the individual fastener strip when the latter is sewn to a garment, for example. U.S. Pat. No. 3,009,235 is believed to exemplify the prior art.

Japanese Utility Model Post-Examination Publication (Kokoku) No. 57-15684 discloses a hooked fastener strip having a plurality of rows of uniformly spaced openings for the passage of a sewing needle. This prior fastener can be sewn at only a fixed pitch of stitching which pitch corresponds to the inter-opening distance.

Another attempt has been proposed by Japanese Utility Model Post-Examination Publication (Kokoku) No. 57-27289 in which the individual fastener strip is made of a woven or knit fabric having non-woven or non-knitted areas in an effort to facilitate the penetrating of a sewing needle. However, because of this non-uniform fabric structure, uniformly shaped engaging elements are difficult to achieve. Further, the engaging elements at the non-woven or non-knitted areas are weak-kneed, thus causing non-stable interengagement of the opposed fastener strips.

SUMMARY OF THE INVENTION

In a surface-type fastener according to the present invention, one surface of a fabric fastener strip has a first region in which a number of engaging elements are disposed, and a second region devoid of engaging elements. The other surface of the fabric fastener strip has, in registry with the first region, an area covered with synthetic resin. Preferably, the second region extends along at least a marginal portion of the fabric fastener strip.

It is therefore an object of the invention to provide a surface-type fastener in which engaging elements on each fabric fastener strip are free from coming off or becoming objectionably loose, thus guaranteeing an improved durability.

Another object of the invention is to provide a surface-type fastener which enables smooth penetrating of a sewing needle through the fabric fastener strip as the latter is sewn to an article, e.g. a garment.

Many other advantages, features and additional objects of the present invention will become manifest to those versed in the art upon making reference to the detailed description and the accompanying drawings in which two embodiments incorporating the principles of the present invention are shown by way of illustrative example.

DETAILED DESCRIPTION

Figure 1:
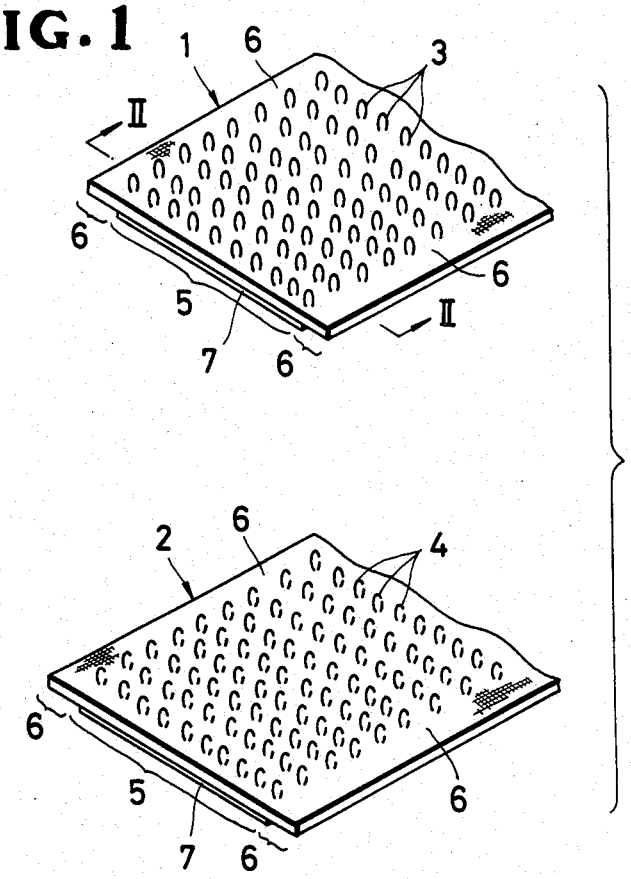
FIG. 1 is a fragmentary perspective view of a looped and a hooked fabric fastener strip of a surface-type fastener embodying the present invention.

FIG. 1 shows a surface-type fastener comprising a pair of interengaging first and second fastener strips 1, 2 each in the form of a woven fabric. The first fabric fastener strip 1 has on its one or front surface a number of loop-shaped engaging elements 3, while the second fabric fastener strip 2 has on its one or front surface a number of hook-shaped engaging elements 4. The loop-shaped engaging elements 3 of the first fastener strip 1 are engageable with the hook-shaped engaging elements 4 of the second fastener strip 2 when the first and second fastener strips 1, 2 are pressed against each other's front surface.

Figure 2:
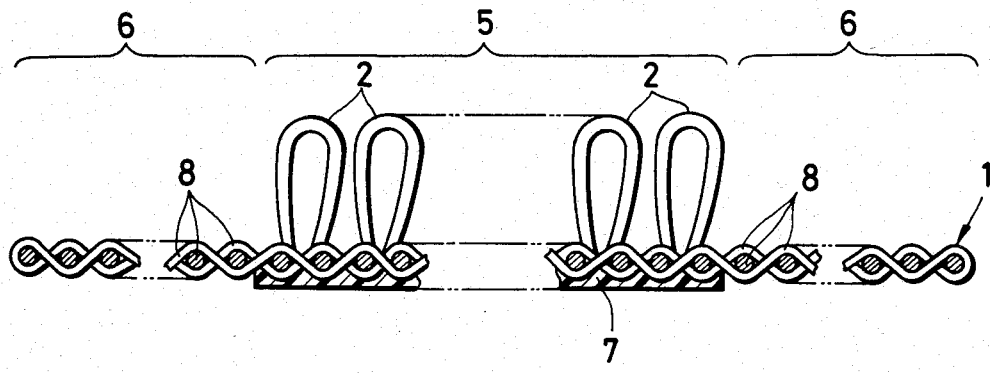
FIG. 2 is a fragmentary, enlarged transverse cross-sectional view taken along line II—II of FIG. 1.

Each of the first and second fastener strips 1, 2 includes a central region 5 in which the respective engaging elements 3, 4 are disposed, and a pair of marginal regions 6, 6 extending along opposed longitudinal edges of the individual fastener strip 1, 2 and devoid of engaging elements. As better shown in FIG. 2, the other or rear surface of each fastener strip 1, 2 is covered with synthetic resin 7, such as polyvinyl chloride or polyester, at only the area which is in registry with the central region 5.

Figure 3:
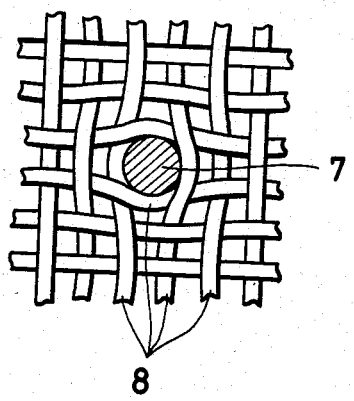
FIG. 3 is a detail view showing the manner in which a sewing needle penetrates the fabric fastener strip during the sewing.

At the central region 5, because of this backing with the synthetic resin 7, the engaging elements 3, 4 are prevented from coming off the fastener strip 1, 2 and from becoming objectionably loose, thus not only causing reliable interengagement of the fastener strips 1, 2, but guaranteeing an improved durability. Further, since the remaining areas in the rear surface of each fastener strip 1, 2 which are in registry with the marginal regions 6, 6 are not covered with the synthetic resin, these marginal regions 6, 6 of the individual fastener strip 1, 2 are sufficiently flexible so that a sewing needle 7 (FIG. 3) can smoothly penetrate therethrough when the fastener is sewn to a garment, for example. As the sewing needle 7 advances in the individual marginal region 6, warp and weft threads 8 (FIGS. 2 and 3) around the sewing needle 7 are deformed or moved sideways, as shown in FIG. 3. With such flexible marginal regions 6, 6, it is possible to sew the fastener onto a garment at a desired pitch of stitching.

In production, an amount of synthetic resin dissolved in a suitable solution was coated over the areas on the rear surface of the individual fastener strips 1, 2 which are in registry with the central region 5, and was then dried. Alternatively, a film of synthetic resin may be attached to that area with an adhesive. In another alternative way, an amount of molten or softened synthetic resin may be applied over the same area by extrusion.

Figure 4:
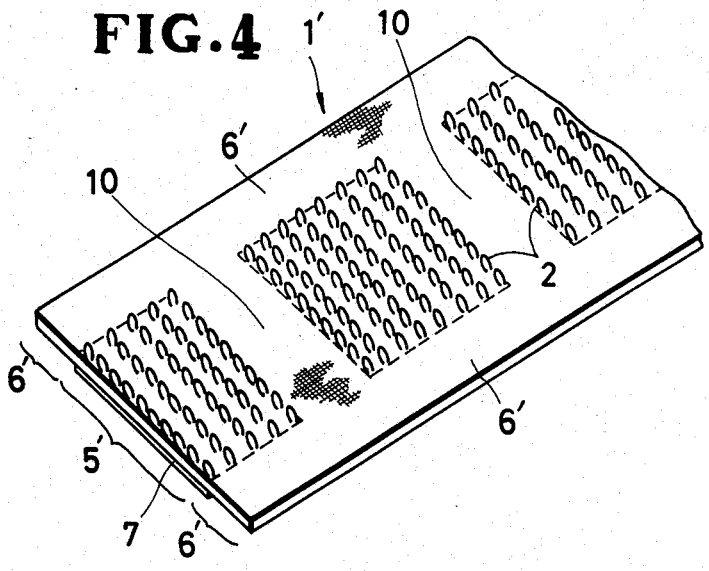
FIG. 4 is a fragmentary perspective view of a modified fabric fastener strip.

FIG. 4 shows a modified fabric fastener strip 1' which is similar to the fastener strip 1 of FIG. 1, except that the central region 5' is divided into sections by a plurality of stripes 10 devoid of engaging elements. The stripes 10 are spaced at intervals along the fastener strip 1', and each stripe 10 extends between the opposite marginal regions 6', 6' transversely of the fastener strip 1'. On the rear surface of the fastener strip 11, in addition to the areas that are in registry with the marginal regions 6', 6', the areas that are in registry with the stripes 10 are not covered with the synthetic resin. With this arrangement, it is possible to sew the fastener strip 1' not only along the marginal regions 6', 6', but along the stripes 10, thus causing easy and stable attachment of the fastener.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A surface-type fastener comprising:

(a) at least a pair of inter-engageable fabric fastener strips, each having on one surface thereof a number of engaging elements; and (b) said one surface of each said fabric fastener strip having a first region in which said engaging elements are disposed, and a second region adjacent thereto devoid of engaging elements, the other surface of each said fabric fastener strip having, in registry with only said frist region, an area covered with non-adhesive synthetic resin so as to stabilize said engaging elements for preventing the latter from being removed from said strip, whereby said fasteener may be attached to an article by sewing threads extending through said second region.

2. A surface-type fastener according to claim 1, said second region extending along at least one elongaged marginal portion of each said fabric fastener strip.

3. A surface-type fastener according to claim 2, said second region extending along opposite marginal portions of each said fabric fastener strip.

4. A surface-type fastener according to claim 3, said second region including a portion extending perpendicularly to both said marginal portions.

5. A surface-type fastener according to claim 2, said second region including a portion extending perpendicularly to said marginal portion.

6. A surface-type fastener according to claim 4, said portion of said second region interconnecting said opposite marginal portions.

* * * * *